US008643307B2

(12) United States Patent
Iwai et al.

(10) Patent No.: US 8,643,307 B2
(45) Date of Patent: Feb. 4, 2014

(54) LIGHTING DEVICE AND LUMINAIRE

(75) Inventors: Naoko Iwai, Yokosuka (JP); Masahiko Kamata, Yokosuka (JP); Hiroshi Terasaka, Yokosuka (JP); Hitoshi Kawano, Yokosuka (JP); Yosuke Saito, Yokosuka (JP)

(73) Assignee: Toshiba Lighting & Technology Corporation, Kanagawa (JP)

( * ) Notice: Subject to any disclaimer, the term of this patent is extended or adjusted under 35 U.S.C. 154(b) by 156 days.

(21) Appl. No.: 13/404,825

(22) Filed: Feb. 24, 2012

(65) Prior Publication Data

US 2012/0217899 A1 Aug. 30, 2012

(30) Foreign Application Priority Data

Feb. 25, 2011 (JP) ..... 2011-040973
Nov. 25, 2011 (JP) ..... 2011-257399

(51) Int. Cl.
*H05B 37/02* (2006.01)

(52) U.S. Cl.
USPC ..... 315/297; 315/244

(58) Field of Classification Search
None
See application file for complete search history.

(56) References Cited

U.S. PATENT DOCUMENTS 5,451,843 A * 9/1995 Kahn et al. ..... 315/186
5,828,178 A * 10/1998 York et al. ..... 315/151
7,550,934 B1 6/2009 Deng et al.
2010/0013393 A1* 1/2010 Onishi et al. ..... 315/119
2010/0181919 A1 7/2010 Sloan et al.
2010/0188002 A1 7/2010 Hung et al.

FOREIGN PATENT DOCUMENTS

JP 2009-010100 1/2009
WO 2010143338 A1 12/2010

OTHER PUBLICATIONS

European Search Report for European Patent Application EP12155743.3 dated Jun. 26, 2012.

* cited by examiner

*Primary Examiner* — Crystal L Hammond
(74) *Attorney, Agent, or Firm* — Patterson & Sheridan, LLP

(57) ABSTRACT

According to one embodiment, a lighting device includes a control circuit that includes a threshold for a case where a pair of the illumination lamps are connected in series between a positive output end and a negative output end of a power supply circuit, and a threshold for a case where one illumination lamp is connected between the positive output end and the negative output end of the power supply circuit. The control circuit determines the connected lamp number of the illumination lamps to a direct-current power supply device based on a voltage between the positive output end and the negative output end of the power supply circuit and a voltage between a non-potential connection end and the positive output end or the negative output end, and selects the threshold corresponding to the connected lamp number to control the direct-current power supply device.

16 Claims, 6 Drawing Sheets

| TYPE OF THRESHOLD (UNIT) | TWO-LAMP SERIES CONNECTION THRESHOLD GROUP (a) | ONE-LAMP CONNECTION THRESHOLD GROUP (b) |
|---|---|---|
| UPPER LIMIT VOLTAGE THRESHOLD THU (V) | 210 | 110 |
| OPEN MODE THRESHOLD THB (V) | TWO-LAMP LAMP VOLTAGE + 20 | LAMP VOLTAGE + 20 |
| SHORT-CIRCUIT MODE THRESHOLD THS (V) | TWO-LAMP LAMP VOLTAGE /2 | LAMP VOLTAGE/2 |
| LOWER LIMIT VOLTAGE THRESHOLD THL (V) | 50 | 25 |

FIG. 4

| LED LAMP CONNECTION MODE | DETECTION OUTPUT OF VfD1 | DETECTION OUTPUT OF VfD2 |
|---|---|---|
| TWO-LAMP SERIES CONNECTION | TWO-LAMP LAMP VOLTAGE | ONE-LAMP LAMP VOLTAGE |
| ONE-LAMP CONNECTION | ONE-LAMP LAMP VOLTAGE | 0V |

FIG. 5

LIGHTING DEVICE AND LUMINAIRE

INCORPORATION BY REFERENCE

The present invention claims priority under 35 U.S.C. §119 to Japanese Patent Application Nos. 2011-040973 and 2011-257399 filed on Feb. 25, 2011 and Nov. 25, 2011, respectively. The contents of these applications are incorporated herein by reference in their entirety.

FIELD

Embodiments described herein relate generally to a lighting device that can light illumination lamps irrespective of the number thereof, and a luminaire including the lighting device.

BACKGROUND

In an illumination lamp lighting device, for example, when an LED as a light source of the illumination lamp is brought into open mode destruction because the illumination lamp is disconnected from a power supply circuit, an arc discharge becomes liable to occur. Thus, the necessity of performing a protecting operation is high. Besides, also when the illumination lamp is shorted and can not be used, since there occurs a load abnormality, the protecting operation is preferably performed.

When the load abnormality occurs, the load abnormality is detected and the illumination lamp lighting device can be made to perform the protecting operation. When the load abnormality is detected by monitoring the output voltage of the power supply circuit, in general, a threshold is set, and when the output voltage deviates from the threshold, a determination is made that there is an abnormality.

On the other hand, for example, when the LED is used as the light source of the illumination lamp, a request may be made to enable a specified number of illumination lamps different from each other in lamp voltage within a range of 45 to 95V to be lit by using the same power supply circuit.

However, in related art, since the threshold of the illumination lamp lighting device is fixed, if the illumination lamps are enabled to be lit irrespective of the number thereof, an appropriate protecting operation can not be performed.

An object of an exemplary embodiment is to provide a lighting device and a luminaire, which applies thresholds corresponding to the connected lamp number of illumination lamps and can appropriately control a power supply circuit.

DESCRIPTION OF THE DRAWINGS

FIG. 4 is a table of the threshold groups at the time of connection of the two illumination lamps and the one illumination lamp.

FIG. 5 is a table showing a condition for determining the connected lamp number of the illumination lamps.

DETAILED DESCRIPTION

In general, according to one embodiment, a lighting device includes a direct-current power supply device, a first voltage detection circuit, a second voltage detection circuit and a control circuit. The direct-current power supply device includes a constant-current controlled power supply circuit and a pair of illumination lamp connection parts, and each of the pair of illumination lamp connection parts includes a pair of terminals to which an illumination lamp can be individually connected. One of the terminals of one of the illumination lamp connection parts is connected to a positive output end of the power supply circuit, and the other of the terminals is connected to a non-potential connection end. One of the terminals of the other of the illumination lamp connection parts is connected to the non-potential connection end, and the other of the terminals is connected to a negative output end of the power supply circuit. A pair of illumination lamps are connected in series between the positive output end and the negative output end of the power supply circuit through the non-potential connection end. The first voltage detection circuit detects a voltage between the positive output end and the negative output end of the power supply circuit. The second voltage detection circuit detects a voltage between the non-potential connection end and the positive output end or the negative output end. The control circuit includes a threshold for a case where the pair of illumination lamps are connected in series between the positive output end and the negative output end of the power supply circuit, and a threshold for a case where the one illumination lamp is connected between the positive output end and the negative output end of the power supply circuit. The control circuit determines the connected lamp number of the illumination lamps to the direct-current power supply device based on detection outputs of the first and the second voltage detection circuit, and selects the threshold corresponding to the connected lamp number to control the direct-current power supply device.

According to this structure, the lighting device and the luminaire can be provided in which the threshold corresponding to the connected lamp number of illumination lamps is applied and the power supply circuit can be appropriately controlled.

Next, a first embodiment will be described with reference to FIG. 1 to FIG. 5.

Figure 1:
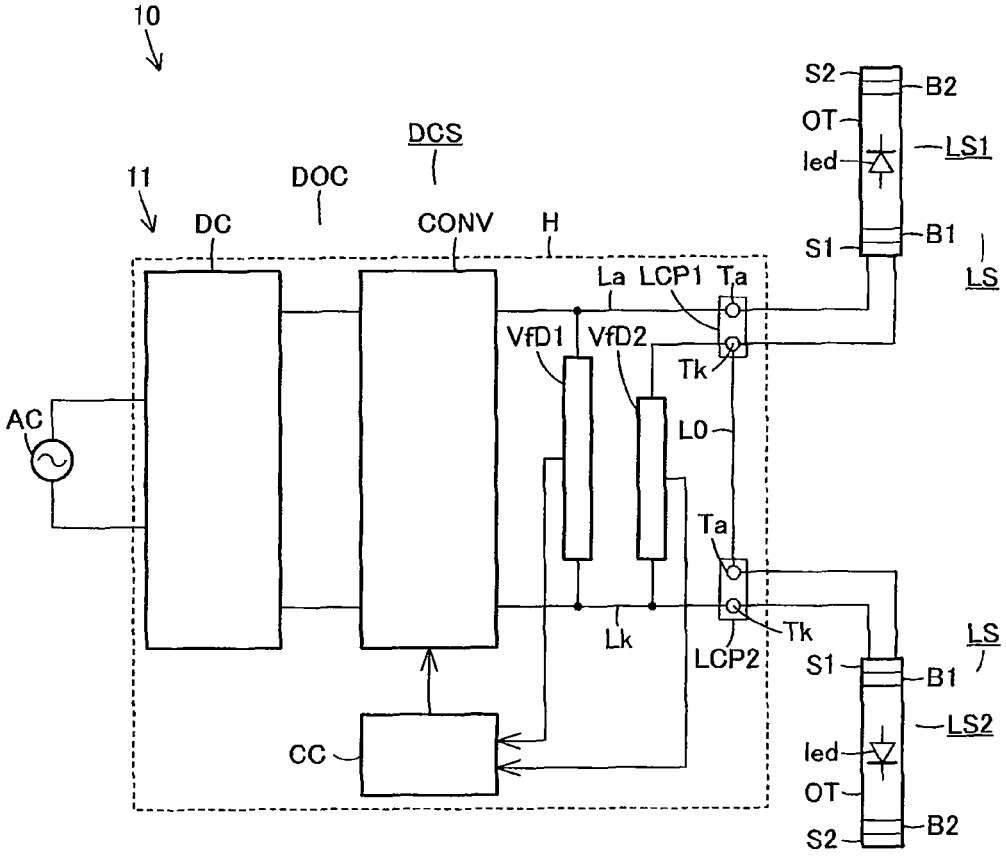
FIG. 1 is a block circuit diagram showing a lighting device and a luminaire of a first embodiment.
Figure 2:
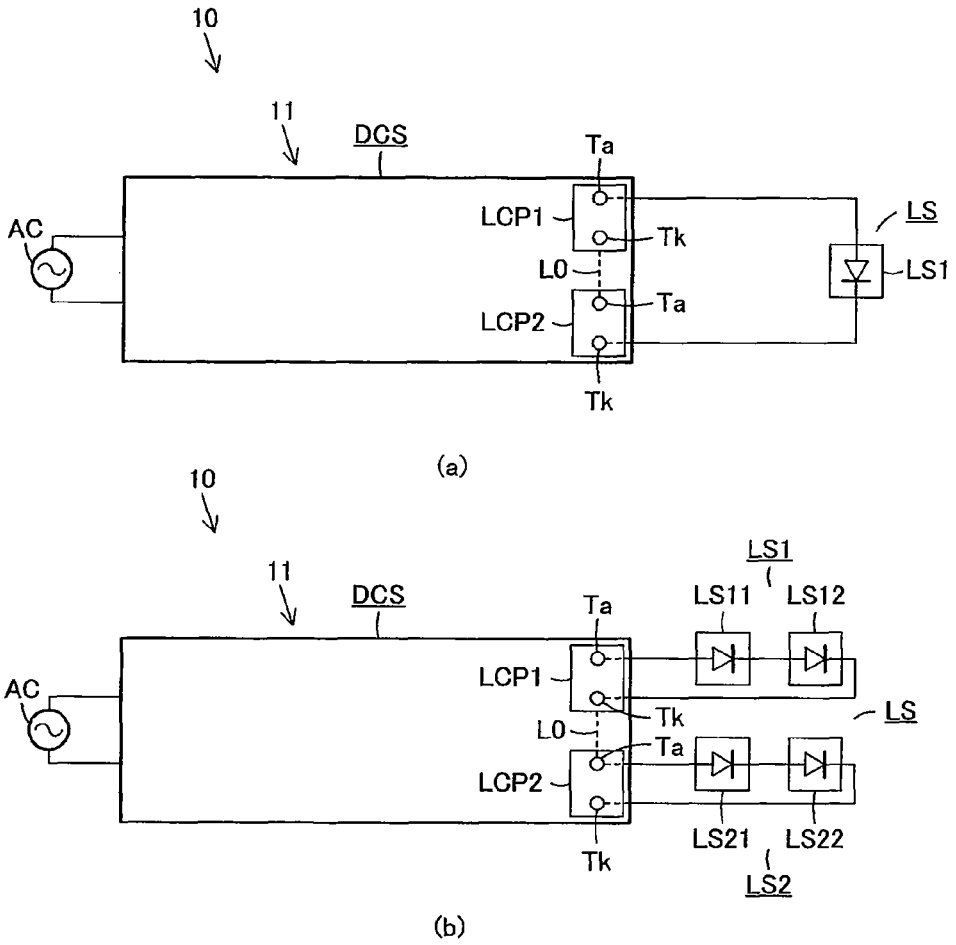
FIGS. 2(*a*) and 2(*b*) are wiring views at the time of connection of two illumination lamps and one illumination lamp in the lighting device and the luminaire.

As shown in FIG. 1 and FIGS. 2(*a*) and 2(*b*), a luminaire 10 includes an LED lamp LS as an illumination lamp and a lighting device 11 to light the illumination lamp LS.

As shown in FIGS. 2(*a*) and 2(*b*), the lighting device 11 is configured such that the two-lamp type or one-lamp type LED lamp LS is selectively connected to a direct-current power supply device DCS and can be lit. As shown in FIG. 1, the lighting device includes the direct-current power supply device DCS, a first and a second voltage detection circuit VfD1, VfD2 and a control circuit CC.

First, the LED lamp LS connected as a load of the direct-current power supply device DCS will be described.

Although the LED lamp LS is preferably used for lighting in this embodiment, the lamp may be used for another use by request. The LED lamp LS to be used includes LEDs led, and the number thereof is not specifically limited. Accordingly, a desired number of LEDs led may be provided in order to obtain a desired amount of light. When plural LEDs led are provided, the plural LEDs can form a series-connected circuit or a series-parallel circuit or a parallel circuit. However, the LED lamp may include a single LED led. Incidentally, the light source of the illumination lamp is not limited to the LED, and may be an electro-luminescence (EL), an organic light-emitting diode (OLED), an organic electro-luminescence (OEL) or the like.

Besides, the LED lamp LS includes a power receiving end for connection with an output end of the direct-current power supply device DCS. Although the power receiving end has preferably a form of a cap, no limitation is made to this. Incidentally, as the cap, structures complying with well-known various cap standards can be adopted by request. In brief, as long as a structure is for connection with the output end of the direct-current power supply device DCS, the remainder of the structure is not specifically limited. For example, the power receiving end may have a form of a connector extended through a conductive wire from the main body of the LED lamp LS. Besides, the power receiving end may be a connection conductor itself.

Further, the LED lamp LS may have various forms. For example, the form may be a straight tube shape in which caps are provided at both ends, or a single cap shape, as in an incandescent lamp, in which a screw cap is provided at one end.

Further, when the two LED lamps LS are connected between a positive output end and a negative output end of the direct-current power supply device DCS, the lamps are connected in series to each other and are lit.

In the illustrated embodiment, the LED lamp LS has a straight tube shape, plural series-connected or series-parallel connected LEDs led are dispersed and arranged in a straight tube-shaped outer tube OT, and caps B1 and B2 are provided at both ends. Incidentally, the LED lamp LS can be constructed so as to satisfy the standard adopting L-shaped pin cap GX16t-5. In this case, the one cap B1 of the caps mounted on both the ends of the outer tube OT is provided with a pair of L-shaped pins that are symmetrically arranged at intervals of 180° around the tube axis, and are connected to both ends of the LED led. On the other hand, the other cap B2 is provided with a protruding pin at the center. However, the protruding pin may have no potential, or may be constructed such that one end of the LED lamp LS is connected to the earth potential through the cap B2. In this embodiment, the cap B2 mainly functions to mechanically support the other end of the LED lamp LS through a socket S2.

The LED lamp LS adopting L-shaped pin cap GX16t-5 is as described below. The specification is stipulated in Japan Electric Lamp Manufacturers Association standards JEL801: 2010 "straight-tube LED lamp system with L-shaped pin cap GX16t (for general lighting)". A part thereof is extracted as follows:

(LDL40 specification) lamp current: direct current 350 mA, lamp voltage: maximum value 95 V, minimum value 45 V (LDL20 specification) lamp current: direct current 350 mA, lamp voltage: maximum value 47.5 V, minimum value 22.5 V.

Next, the direct-current power supply device DCS will be described.

The direct-current power supply device DCS includes a constant-current controlled power supply circuit DOC and LED lamp connection parts LCP1 and LCP2 as a pair of illumination lamp connection parts.

The power supply circuit DOC is constant-current controlled, and includes a positive output end La and a negative output end Lk to output direct-current voltage. Incidentally, as the structure for performing the constant-current control, a well-known control circuit can be appropriately adopted. Since the power supply circuit DOC is constant-current controlled, the light output of the LED lamp LS connected as a load between the positive output end La and the negative output end Lk is easily lit at a constant level, and an LED lamp LS having a different rated lamp voltage can also be lit.

In the embodiment shown in FIG. 1, the power supply circuit DOC includes a direct-current power supply DC and a DC-DC converter CONV. The direct-current power supply DC may be a battery power supply or a rectifier power supply. In the case of the rectifier power supply, a rectifying circuit such as a diode bridge or a smoothing circuit, whose input end is connected to an alternating-current power supply AC can be used. As the smoothing circuit, an active filter such as a smoothing capacitor or a booster chopper can be used. Incidentally, by using the active filter, harmonics flowing to the alternating-current power supply AC side can be effectively reduced.

The DC-DC converter CONV is a circuit that generally converts an input direct-current voltage to a different direct-current voltage. The output voltage is applied to the LED lamp LS to light it. Accordingly, if the DC-DC converter CONV is used in the power supply circuit DOC, the DC-DC converter CONV functions as the main part of the power supply circuit DOC. Incidentally, the concept of the DC-DC converter CONV includes a flyback converter, a forward converter, a switching regulator or the like in addition to various choppers. The output of the DC-DC converter CONV is controlled and the output current is adjusted, so that the LED lamp LS can be dimmed and lit at a desired level. Incidentally, among them, the copper has a high conversion efficiency, the circuit structure is simple and the control is easy. Accordingly, the chopper is preferable as the DC-DC converter CONV in this embodiment.

Besides, if the power supply circuit DOC is mainly composed of the DC-DC converter CONV as described above, the direct-current power supply DC and the DC-DC converter CONV can be arranged in one-to-one correspondence. Besides, the structure may be made such that the direct-current power supply DC is made common, plural DC-DC converters CONV are provided in one-to-plural correspondence, and the direct-current input is supplied in parallel to the plural DC-DC converters CONV. Incidentally, in the latter case, the respective DC-DC converters CONV are provided at positions adjacent to the LED lamp LS, and the common direct-current power supply DC can be provided at a position separate from the LED lamp LS by request.

Further, although the power supply circuit DOC is configured so as to be constant-current controlled as described above, in this embodiment, the constant-current control is configured such that for example, a current detection circuit is connected in series to a load, and the detection output thereof is negatively feedback-controlled to, for example, the DC-DC converter CONV of the power supply circuit DOC, so that the constant-current control is performed. Incidentally, a composite control characteristic may be provided such that in a partial region, for example, in an operation region where the lighting power of the LED lamp LS is low, in other words, in a deep dimming region, constant-voltage control is performed, and in the other region, the constant-current control is performed.

Further, in order to change the operation state of the LED lamp LS, the power supply circuit DOC can be configured such that the output of the power supply circuit DOC can be changed so as to change the direct current supplied to the LED lamp LS according to an output control signal, for example, a dimming signal. That is, the structure can be made such that a dimming signal generation circuit is provided inside or outside the direct-current power supply device DCS, and the LED lamp LS is dimmed and lit according to the dimming signal sent from the circuit. Incidentally, the dimming signal may be modulated by using a PWM modulation system.

Further, the power supply circuit DOC is configured such that even if the LED lamp LS having a lamp voltage of 45 to 95V is connected to the output end, this lamp can be normally lit. The power supply circuit DOC is constant-current controlled, so that the output voltage is changed correspondingly to the lamp voltage of the LED lamp LS.

Next, the pair of LED lamp connection parts LCP1 and LCP2 will be described.

The single LED lamp LS or plural LED lamps LS series-connected to form a group can be connected to each of the pair of LED lamp connection parts LCP 1 and LCP 2. Thus, each of the LED lamp connection parts LCP 1 and LCP 2 includes a pair of terminals Ta and Tk. The pair of terminals Ta and Tk are preferably disposed to be relatively close to each other so that the terminals are easily differentiated from the other LED lamp connection part when the terminals connect the LED lamp LS.

Besides, the pair of LED lamp connection parts LCP1 and LCP2 correspond to the two LED lamps LS1 and LS2 which may be connected in series to the power supply circuit DOC. In the one LED lamp connection part LS1, the one terminal Ta is connected to the positive output end La of the power supply circuit DOC, and the other terminal Tk is connected to a non-potential connection end L0. In the other LED lamp connection part LCP2, the one terminal Ta is connected to the non-potential connection end L0, and the other terminal Tk is connected to the negative output end Lk of the power supply circuit DOC. Incidentally, in the above, the non-potential connection end L0 is a conductive circuit which is connected neither to the positive output end La of the power supply circuit DOC nor to the negative output end Lk in the state where the LED lamp LS is not connected, and to which the power receiving end of the LED lamp LS can be directly or indirectly connected. In the illustrated embodiment, a pair of lead wires extended from each of a pair of sockets S1 and S1 are connected to each of the pair of LED lamp connection parts LCP1 and LCP2. The caps B1 of the LED lamps LS1 and LS2 are mounted on the sockets S1, so that the lamps are connected to the pair of LED lamp connection parts LCP1 and LCP2.

When the two LED lamps LS1 and LS2 are connected to the pair of LED lamp connection parts LCP1 and LCP2, the other terminal Tk of the one LED lamp connection part LCP1 and the one terminal Ta of the other LED lamp connection part LCP2 are commonly connected to the non-potential connection end L0. Thus, the two LED lamps LS1 and LS2 are connected in series between the positive output end La and the negative output end Lk of the power supply circuit DOC through the non-potential connection end L0 and can be lit.

Incidentally, when the LED lamp LS is connected to the single LED lamp connection part LCP1 or LCP2, as shown in the mode of two-lamp type series connection of FIG. 2(*b*), plural LED lamps LS11 and LS12, LS21 and LS22 are series-connected by request, and they can be respectively regarded as one-lamp type LED lamp LS1 and LS2. For example, in the foregoing Japan Electric Lamp Manufacturers Association standards, as is understood from the fact that if two LED lamps LS of LDL20 specification are connected in series to each other, the same electric rating as one LED lamp of LDL40 specification can be obtained, the plural series-connected LED lamp LS11 and LS12 connected to the single LED lamp connection part LCP1 or LCP2 can be regarded as the single LED lamp LS.

On the other hand, when one LED lamp LS, for example, only the LED lamp LS1 is connected to the direct-current power supply device DCS as shown in FIG. 2(*a*), the LED lamp LS1 is connected between the one terminal Ta of the one LED lamp connection part LCP1 and the other terminal Tk of the other LED lamp connection part LCP2. By this, the one LED lamp LS1 is connected between the positive output end La and the negative output end Lk of the power supply circuit DOC and can be lit.

Further, the pair of LED lamp connection parts LCP1 and LCP2 have only to be connected to the power receiving ends of the LED lamp LS directly or indirectly through, for example, the socket, and the remainder of the structure is not specifically limited. For example, a form of a terminal block may be adopted. Incidentally, since the pair of LED lamp connection parts LCP1 and LCP2 constitute a part of the direct-current power supply device DCS, the connection parts are preferably contained inside a surrounding housing H such as a case to surround the power supply circuit DOC and the like. In this case, in order to facilitate the connection of a lead wire of the socket S1 to the pair of LED lamp connection parts LCP1 and LCP2 from the outside of the surrounding housing H by request, an operation part of the LED lamp connection parts LCP1 and LCP2 or a part of the connection parts can be exposed to the outside.

Next, the first voltage detection circuit VfD1 will be described.

The first voltage detection circuit VfD1 detects a voltage between the positive and the negative output ends La and Lk of the power supply circuit DOC. Accordingly, if the LED lamp LS is connected to the power supply circuit DOC, the first voltage detection circuit VfD1 can detect the lamp voltage irrespective of the number of lamps and can detect an abnormal voltage generated when de-mounting or open mode failure of the LED lamp LS occurs.

Next, the second voltage detection circuit VfD2 will be described.

The second voltage detection circuit VfD2 detects a voltage between the non-potential connection end L0 and the negative output end Lk. Accordingly, as shown in FIG. 1, if the two LED lamps LS1 and LS2 are connected in series to the direct-current power supply device DCS, the second voltage detection circuit VfD2 can detect the lamp voltage of the other LED lamp LS2 connected to the negative output end Lk and an abnormal voltage generated when de-mounting or open mode failure of the LED lamp LS occurs. Besides, as shown in FIG. 2(*a*), when one LED lamp, for example, only the LED lamp LS1 is connected between the positive output end La and the negative output end Lk of the power supply circuit DOC, the detection voltage of the second voltage detection circuit VfD2 becomes 0 V. Incidentally, the second voltage detection circuit VfD2 may detect a voltage between the non-potential connection end L0 and the positive output end La.

In the case of the two-lamp series connection, if the detection output of the second voltage detection circuit VfD2 is subtracted from the detection output of the first voltage detection circuit VfD1, when the two LED lamps LS1 and LS2 are connected in series to the direct-current power supply device DCS, the lamp voltage of only one LED lamp LS or the abnormal voltage generated when the open mode such as the de-mounting occurs can be detected. Accordingly, if the first voltage detection circuit VfD1 and the second voltage detection circuit VfD2 are provided, the lamp voltages of the two LED lamps LS1 and LS2 or the abnormal voltage generated when the open mode such as the de-mounting occurs can be individually detected.

Next, the control circuit CC will be described.

The control circuit CC has a threshold for a case where the pair of LED lamps LS1 and LS2 are connected in series to the power supply circuit DOC of the direct-current power supply device DCS, and a threshold for a case where the one LED lamp LS1 is connected as shown in FIG. 2(*a*). Incidentally, these thresholds may constitute a threshold group including plural thresholds. The control circuit CC determines the connected lamp number of the LED lamps LS to the power supply circuit DOC based on the detection outputs of the first and the second voltage detection circuit VfD1, VfD2. Then, a threshold corresponding to the determined connected lamp number is selected, and a threshold is determined each time according to a sampling value when a lighting condition is changed. Besides, the power supply circuit DOC is suitably controlled so as not to deviate from the determined threshold. In this embodiment, a threshold group (a) applied in a mode of two-lamp series connection as shown in FIG. 3(*a*) and a threshold group (b) applied in a mode of one-lamp connection as shown in FIG. 3(*b*) are previously prepared in the control circuit CC.

Figure 3:
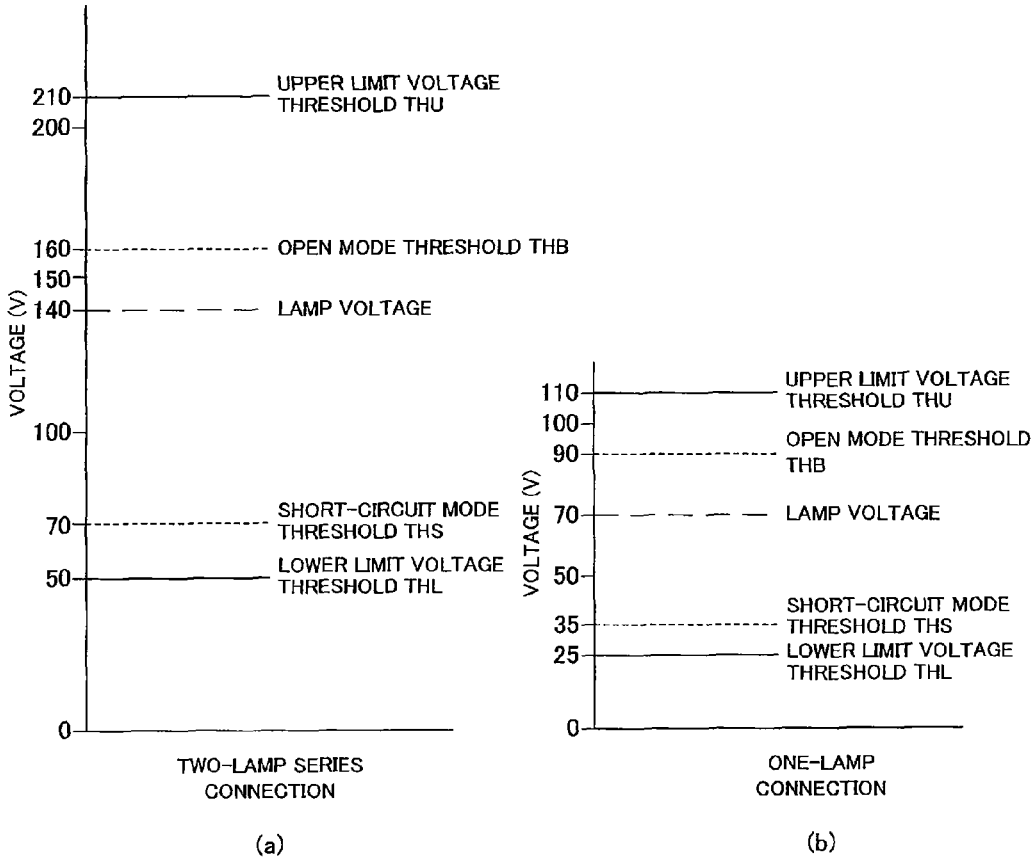
FIGS. 3(*a*) and 3(*b*) are explanatory views of threshold groups at the time of connection of the two illumination lamps and the one illumination lamp.

In this embodiment, although the configuration of the thresholds is not specifically limited, in the embodiment shown in FIGS. 3(*a*) and 3(*b*), in both the threshold groups (a) and (b), an upper limit value, that is, an upper limit voltage threshold THU, a lower limit value, that is, a lower limit voltage threshold THL, an open mode threshold THB, and a short-circuit mode threshold THS are set. Among the respective thresholds, the upper limit voltage threshold THU and the lower limit voltage threshold THL are formed of absolute fixed values. On the other hand, the open mode threshold THB and the short-circuit threshold THS are formed of relatively variable values with respect to the lamp voltage of the LED lamp LS.

That is, the upper limit value, that is, the upper limit voltage threshold THU, and the lower limit value, that is, the lower limit voltage threshold THL are the absolutely fixed thresholds which are set to enable the LED lamps LS different from each other in load voltage to be lit by using the same power supply circuit DOC within the permissible range of lamp voltage of, for example, 45 to 95 V, and are set to cause the power supply circuit DOC to perform a protecting operation when an unauthorized LED lamp LS having a lamp voltage deviating from the permissible range is mounted. Among them, the upper limit voltage threshold THU is useful to cause the power supply circuit DOC to perform the protecting operation when an LED lamp LS having a lamp voltage of more than 95V is mounted and the lamp voltage rises and exceeds the upper limit voltage threshold THU. Besides, the lower limit voltage threshold THL is useful to cause the power supply circuit DOC to perform the protecting operation when an LED lamp LS having a lamp voltage of less than 45V is mounted and the lamp voltage is reduced and becomes lower than the lower limit voltage threshold THL.

On the other hand, the open mode threshold THB and the short-circuit mode threshold THS are thresholds which are for the normal LED lamp LS having a lamp voltage in a range of, for example, 45 to 95V and are relatively variable according to the lamp voltage, and are the thresholds which are set to cause the power supply circuit DOC to perform the protecting operation at the time of occurrence of abnormality of the LED lamp LS during lighting. Among them, the open mode threshold THB is the threshold to cause the protecting operation to be performed when the lamp voltage exceeds this threshold, so that arc discharge does not occur at the time of de-mounting of the LED lamp LS or open mode failure of the LED lamp LS. Incidentally, in the above, the "de-mounting" means that the LED lamp LS mounted on the output end of the power supply circuit DOC is detached from the output end of the power supply circuit DOC because of some reason such as shock or vibration applied from the outside during lighting, or the contact becomes loose and the contact resistance becomes large. When the connection is detached, the arc discharge is apt to occur at that time. Since the power supply circuit DOC is constant-current controlled, when the connection is detached, an output voltage Vf of the power supply circuit DOC increases, and accordingly, the arc discharge is more apt to occur. The short-circuit mode threshold THS is the threshold for causing the power supply circuit DOC to perform the protecting operation when the short-circuit occurrence number of LEDs led inside the LED lamp LS deviates from a permissible range and becomes lower than this, the LED lamp is brought into such a state that the LED lamp can not be used as the light source, and the lamp voltage is reduced.

In the embodiment shown in FIGS. 3(*a*) and 3(*b*), if the LED lamp LS complies with the LDL40 specification and the rated lamp voltage is 70V, examples of the threshold group (a) applied in the mode of two-lamp series connection and the threshold group (b) applied in the mode of one-lamp connection are as shown in FIG. 4. Incidentally, with respect to the open mode threshold THB and the short-circuit mode threshold THS, as the example, the thresholds are shown in FIGS. 3(*a*) and 3(*b*) in which the lamp voltage is 70V. Although a voltage of 20V added to the lamp voltage indicates an abnormal voltage rising from the lamp voltage, the voltage may be set with some margin, and can be set within a range of, for example, 15 to 23V.

Besides, when the control circuit CC selects one of the two threshold groups (a) and (b), the control circuit determines the connected lamp number of the LED lamps LS to the direct-current power supply device DCS based on the condition shown in FIG. 5 when the power supply is applied and the direct-current power supply device DCS starts the operation, and selects the threshold group according to the determined connected lamp number. Incidentally, the time when the direct-current power supply device DCS starts the operation may be after or before the DC-DC converter CONY of the power supply circuit DOC of the direct-current power supply device DCS starts the oscillation. Also in the case prior to the start of the oscillation, a low voltage obtained through an auxiliary power supply circuit from the alternating-current power supply AC, for example, a direct-current control voltage Vcc obtained by starting a not-shown direct-current control power supply at the time of turning on the alternating-current power supply AC prior to the power supply circuit DOC, is applied to the first and the second voltage detection circuit VfD1, VfD2 and the load circuit, that is, the LED lamp LS. As a result, the voltage-dividing resistance value is changed according to the presence or absence of the LED lamp LS, and the detection output is changed. Thus, even at the time before the power supply circuit DOC starts to oscillate, the connected lamp number of the LED lamps LS can be determined according to the detection outputs of the first and the second voltage detection circuit VfD1, VfD2 shown in FIG. 5. The control circuit CC can select the relevant threshold group from the threshold group (a) applied to the two-lamp series connection mode and the threshold group (b) applied to the one-lamp connection mode according to the result of the connected lamp number determination.

Further, the control circuit CC applies the thresholds of FIG. 4 corresponding to the connected lamp number during lighting of the LED lamp LS, and controls the power supply circuit DOC of the direct-current power supply device DCS. When the detection outputs of the first and the second voltage detection circuit VfD1, VfD2 deviate from the thresholds shown in FIG. 4, the control circuit causes the power supply circuit DOC of the direct-current power supply device DCS to perform the protecting operation. As the protecting operation, although it is preferably to turn off the LED lamp LS, the light output maybe reduced by narrowing down the lamp current.

In this embodiment, the control circuit CC is configured to perform the determination of the connected lamp number of the LED lamp LS, the selection of the threshold group and the control by the application, and further to perform the other operation control of the direct-current power supply device DCS.

Further, in this embodiment, when the control circuit CC determines the open mode threshold THB and the short-circuit mode threshold THS, which are the relatively variable thresholds, each time according to the change of the lighting condition of the LED lamp LS, the determination is made as described below.

That is, the open mode threshold THB and the short-circuit mode threshold THS have such characteristics that the values are changed according to the change of the lighting condition of the LED lamp LS. Then, the output voltage of the power supply circuit DOC is directly monitored, and the change of the lighting condition can be determined. In this case, when the output voltage is changed, it is necessary to accurately grasp whether the change is the normal change of the lighting condition or whether an abnormal state occurs. In order to grasp this, for example, the change amount of the output voltage or the change pattern is preferably carefully monitored.

However, instead of the foregoing mode, the change of the lighting condition of the LED lamp LS maybe indirectly checked. That is, the change of the lighting condition of the LED lamp LS can be known by checking a control signal, for example, a dimming signal. Since this mode can be performed relatively easily, this is recommendable. Besides, in the case of the change of the lighting condition caused by replacing the illumination lamp LS, which is lit until now, by an LED lamp LS having a different rated lamp voltage, the lamp replacement is preferably performed after the power supply is once turned off. If doing so, when the power supply is again turned on after the replacement of the lamp, the output voltage is monitored and the threshold can be newly set by the foregoing method.

If the power supply circuit DOC is constant-current controlled, since the change of the lamp voltage during lighting of the LED lamp LS is relatively low, by request, a suitable ramp voltage, for example, a rated lamp voltage is made a reference value, and thresholds, for example, the open mode threshold THB and the short-circuit mode threshold THS may be determined based on the reference value.

Incidentally, the control circuit CC can be configured by adding, in addition to the control for causing the power supply circuit DOC to perform the protecting operation, functions such as control for giving constant-current control output characteristics to the power supply circuit DOC, and output adjustment control for dimming and lighting the LED lamp LS.

Besides, although the control circuit CC is preferably mainly composed of a digital device, for example, a microcomputer, an analog circuit unit maybe used by request.

As described above, according to this embodiment, both the plural LED lamps LS and the one LED lamp LS can be lit, and when the lighting condition is changed, the output voltage of the power supply circuit DOC is sampled, and the threshold is determined according to the sampling value each time. Thus, even if the output voltage is changed by the variation of the lighting condition, the threshold is again set in accordance with the change, and the power supply circuit DOC can perform the protecting operation when the output voltage is changed and deviates from the threshold.

Figure 6:
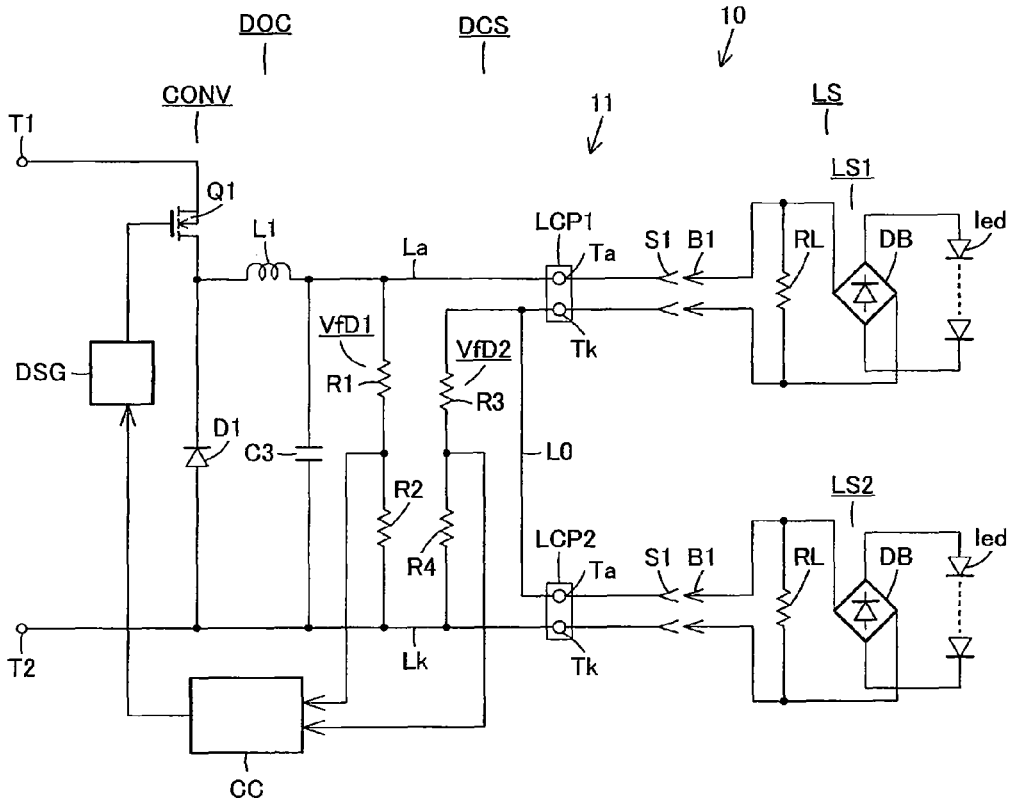
FIG. 6 is a circuit view showing a lighting device and a luminaire of a second embodiment.

Next, a second embodiment will be described with reference to FIG. 6. Incidentally, the same portion as that of FIG. 1 is denoted by the same reference character and its description is omitted.

In the second embodiment, a DC-DC converter CONY of a power supply circuit DOC constitutes a step-down chopper, each of a first and a second voltage detection circuit VfD1, VfD2 is composed of a voltage dividing circuit, a pair of LED lamps LS1 and LS2 include a substantial structure.

First, the pair of LED lamps LS1 and LS2 will be described. Each of the pair of LED lamps LS1 and LS2 includes a bleeder resistor RL and a diode bridge DB connected in parallel. Incidentally, the bleeder resistor RL can facilitate the detection of the first and the second voltage detection circuit VfD1, VfD2 when the LED lamp LS is connected to lamp connection parts LCP1 and LCP2. The diode bridge DB causes the connection of the LED lamp LS to a positive output end La and a negative output end Lk of the power supply circuit DOC to have no polarity.

Next, the step-down chopper will be described. In the step-down chopper, a series circuit of a switching element Q1, an inductor L1 and an output capacitor C3 is connected to input ends T1 and T2. Incidentally, the switching element Q1 is supplied with a drive signal from a drive signal generation circuit DSG and performs a switching operation.

Besides, a series circuit of a diode D1 and the output capacitor C3 is connected in parallel to the inductor L1 in an illustrated polarity, and a closed circuit of those is formed. The pair of the positive output end La and the negative output end Lk of the DC-DC converter CONV of the power supply circuit DOC are extracted from both ends of the output capacitor C3. Sockets S1 are connected to terminals Ta and Tk of each of the pair of lamp connection parts LCP1 and LCP2 through conductive wires. Accordingly, caps B1 of the two LED lamps LS1 and LS2 are mounted on the sockets S1 so that the LED lamps are connected to the pair of lamp connection parts LCP1 and LCP2 and are mechanically supported.

Next, the first voltage detection circuit VfD1 will be described. The first voltage detection circuit VfD1 is configured such that a series circuit of resistors R1 and R2 is connected between the positive output end La and the negative output end Lk of the power supply circuit DOC, and the voltage of the resistor R2 is control-inputted as a detection output to a control circuit CC. Incidentally, although not shown, a capacitor is connected in parallel to the resistor R2, and the detection output is averaged.

Next, the second voltage detection circuit VfD2 will be described. The second voltage detection circuit VfD2 is configured such that a series circuit of resistors R3 and R4 is connected between a non-potential connection end L0 and the negative output end Lk, and the voltage of the resistor R4 is control-inputted as a detection output to the control circuit CC. Incidentally, although not shown, a capacitor is connected in parallel to the resistor R4 similarly to the first voltage detection circuit VfD1, and the detection output is averaged.

Next, the control circuit CC will be described. The control circuit CC is composed of a microcomputer that receives a direct-current control voltage Vcc from an auxiliary power supply circuit connected to an alternating-current power supply AC and operates. Besides, the control circuit CC is configured to control the power supply circuit DOC by controlling the drive signal generation circuit DSG.

Next, under the understanding of the above description, the procedure of protecting operation control will be described based on a flowchart shown in FIG. 7.

[Connected Lamp Number Determination]

When the alternating-current power supply AC is turned on, a connected lamp number determination is first performed. The connected lamp number determination is performed mainly by the control circuit CC. That is, based on the condition shown in FIG. 5 and according to sampling values obtained from the detection outputs of the first and the second voltage detection circuit VfD1, VfD2, the control circuit CC determines whether the LED lamp LS connected to the pair of LED lamp connection parts LCP1 and LCP2 has one lamp or two lamps in the direct-current power supply device DCS. Incidentally, the detection outputs of the first and the second voltage detection circuit VfD1, VfD2 are values obtained by averaging the terminal voltages of the resistors R2 and R4 of FIG. 6 by the not-shown capacitors connected in parallel to the resistors R2 and R4. The values are sampled for a specified time, so that the averaged sampling values are obtained.

Figure 7:
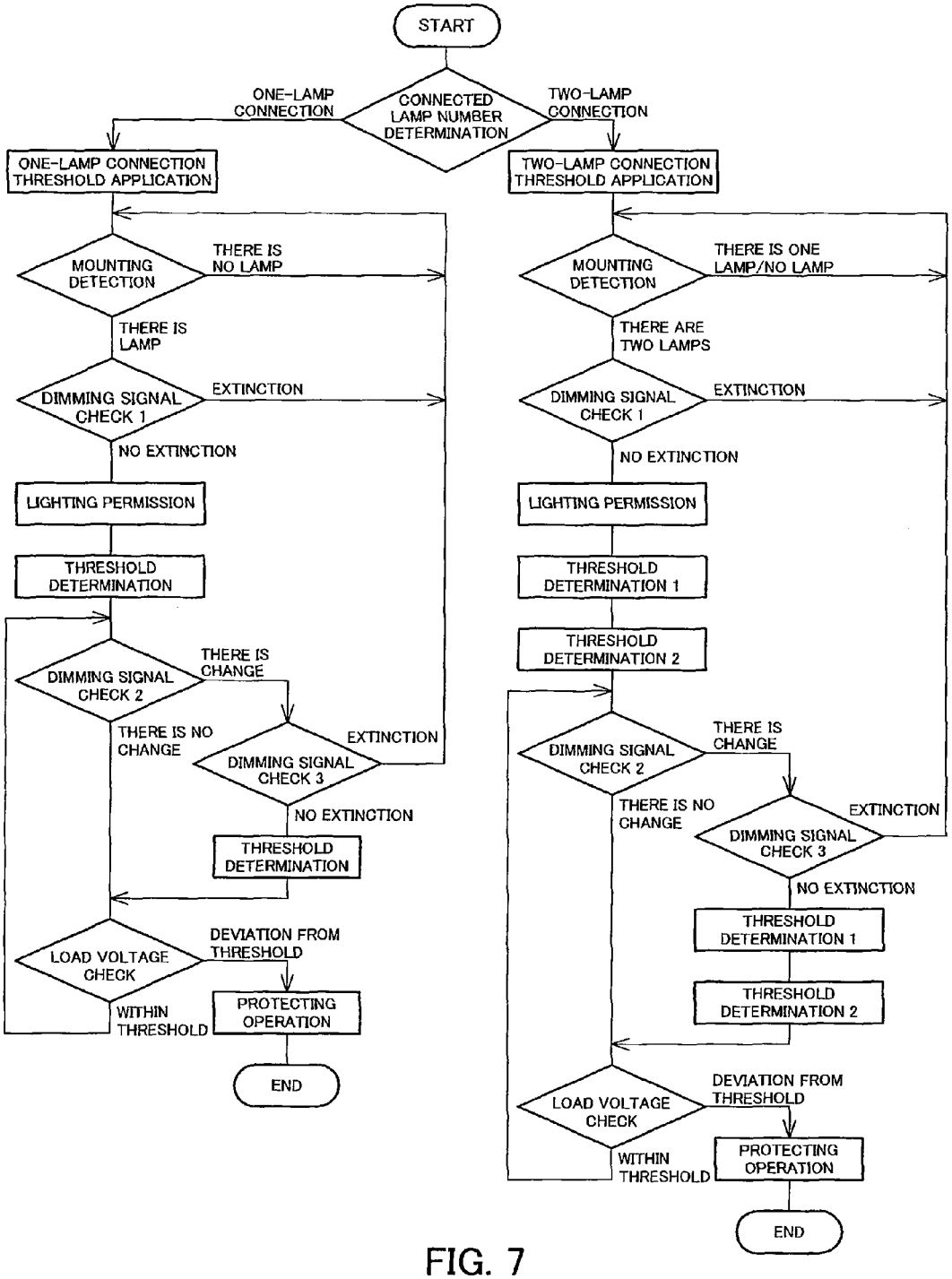
FIG. 7 is a flowchart of a protecting operation of the lighting device and the luminaire.

As a result of the connected lamp number determination, if the LED lamp LS has one-lamp connection, the control circuit CC shifts to the left side in FIG. 7, and determines that the thresholds shown in FIG. 3(*b*) are applied. If the LED lamp LS has two-lamp connection, the control circuit CC shifts to the right side in FIG. 7, and determines that the thresholds shown in FIG. 3(*a*) are applied.

First, the flow of the protecting operation control in the case of one-lamp connection will be described.

[Case Where the Connected Lamp Number is One]

[Mounting Detection]

Next, mounting detection is performed. This mounting detection is performed through the detection output of the first voltage detection circuit VfD1. At this time, detection output does not occur in the second voltage detection circuit VfD2. The control circuit CC determines whether or not the detection output of the first voltage detection circuit VfD1 exceeds, for example, the open mode threshold THB shown in the one-lamp connection threshold group (b) of FIG. 4, and detects the presence or absence of de-mounting. As described before, if the first voltage detection circuit VfD1 is configured to operate even in the initial state where only the low control power supply Vcc is applied, the mounting detection can be performed immediately after turning on the power supply and before the start of the power supply circuit DOC.

If the result of the mounting detection is "there is lamp" in which the LED lamp LS is mounted on the output ends La and Lk of the power supply circuit DOC, a shift is made to next dimming signal check 1. If the result of the mounting detection is "there is no lamp" in which the lamp is not mounted, the mounting detection is again repeated.

[Dimming Signal Check 1]

In the dimming signal check 1, the presence or absence of extinction of the LED lamp LS is checked based on a dimming signal. If the result is "no extinction", lighting is permitted in "lighting permission" and further, thresholds are determined based on the one-lamp connection threshold group (b) of FIG. 4 in "threshold determination". When the thresholds are determined, the control circuit CC starts the operation of the power supply circuit DOC, and next, an advance is made to dimming signal check 2. The result of the dimming signal check 1 is "extinction", a return is made to the mounting detection, and the above protecting operation control is again repeated.

[Dimming Signal Check 2]

After the lighting permission is obtained and the LED lamp LS is lit, the dimming signal check 2 is performed. In the dimming signal check 2, the presence or absence of change of the dimming signal is checked. If the result is "there is no change", a shift is made to next load voltage check. If the result of the dimming signal check 2 is "there is change", an advance is made to dimming signal check 3.

[Dimming Signal Check 3]

In the dimming signal check 3, the presence or absence of extinction of the LED lamp LS is again checked based on the dimming signal. If the result is "no extinction", thresholds are again determined. Then, an advance is made to the load voltage check. If the result of the dimming signal check 3 is "extinction", a return is again made to the mounting detection, and the above protecting operation control is repeated.

[Load Voltage Check]

In the load voltage check, the load voltage detected by the first voltage detection circuit VfD1 is compared with the threshold, and a check is made as to whether or not the power supply circuit DOC is required to perform the protecting operation in order to protect the LED lamp LS side. As a result, if the load voltage is "within threshold" and does not deviate from the threshold, a return is again made to the dimming signal check 2. If the result of the load voltage check is "deviation from threshold", the power supply circuit DOC is made to perform the protecting operation and the protecting operation control is ended.

Next, the flow of the protecting operation control in the case of two-lamp connection shown on the right side of FIG. 7 will be described.

[Case Where the Connected Lamp Number is Two]

[Mounting Detection]

This mounting detection is performed based on detection outputs of the first and the second voltage detection circuit VfD1, VfD2. That is, the control circuit CC determines whether or not the detection outputs of the first and the second voltage detection circuit VfD1, VfD2 exceed, for example, the open mode threshold THB shown in the threshold group (a) of FIG. 4, and detects the presence or absence of de-mounting. Incidentally, because of the same reason as the case of the one-lamp connection, the mounting detection can be performed before the power supply circuit DOC starts.

If the result of the mounting detection is "there are two lamps" in which the LED lamps LS are mounted on the output ends La and Lk of the power supply circuit DOC, a shift is made to next dimming signal check 1. If the result of the mounting detection is "there is one lamp" or "there is no lamp", the mounting detection is again repeated.

[Dimming Signal Check 1]

In the dimming signal check 1, the presence or absence of extinction of the LED lamp LS is checked based on the dimming signal. If the result is "no extinction", lighting is permitted in "lighting permission", and "threshold determination 1" and " threshold determination 2" are performed. In the "threshold determination 1", for example, the thresholds of the LED lamp LS1 of FIG. 1 are determined. In the "threshold determination 2", for example, the thresholds of the LED lamp LS2 of FIG. 1 are determined. When the thresholds are determined in this way, the control circuit CC starts the operation of the power supply circuit DOC, and next proceeds to dimming signal check 2. The result of the dimming signal check 1 is "extinction", a return is made to the mounting detection, and the above protecting operation control is again repeated.

[Dimming Signal Check 2]

After the lighting permission is obtained and the LED lamp LS is lit, the dimming signal check 2 is performed based on the dimming signal. In the dimming signal check 2, the presence or absence of change of the dimming signal is checked. If the result is "there is no change", a shift is made to next load voltage check. If the result of the dimming signal check 2 is "there is change", an advance is made to dimming signal check 3.

[Dimming Signal Check 3]

In the dimming signal check 3, the presence or absence of extinction of the LED lamp LS is again checked based on the dimming signal. If the result is "no extinction", "threshold determination 1" and "threshold determination 2" are again performed. The "threshold determination 1" and the "threshold determination 2" are the same as those in the "dimming signal check 1". Next, an advance is made to the load voltage check. If the result of the dimming signal check 3 is "extinction", a return is again made to the mounting detection, and the above protecting operation control is repeated.

[Load Voltage Check]

In the load voltage check, the load voltages detected by the first and the second voltage detection circuit VfD1, VfD2 are compared with the thresholds, and a check is made as to whether or not the power supply circuit DOC is required to perform the protecting operation in order to protect the LED lamp LS side. As a result, if the load voltage is "within threshold" and does not deviate from the threshold, a return is again made to the dimming signal check 2. If the result of the load voltage check is "deviation from threshold", the power supply circuit DOC is made to perform the protecting operation and the protecting operation control is ended.

Finally, an embodiment of a luminaire will be described. The luminaire includes a luminaire main body and a lighting device 11.

The luminaire main body includes a portion obtained by removing the lighting device 11 from the luminaire. The luminaire main body may include an LED lamp LS, a socket to mount the LED lamp LS, a light control member such as a reflector and a container body. The container body supports the socket, the light control member, the lighting device 11 and the like, and includes a required wiring member and may include an attachment unit to a building or the like.

The lighting device 11 is the lighting device 11 of the first or the second embodiment, and may be supported by the container body as described above or may be placed separately from the container body.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A lighting device comprising:

a direct-current power supply device that includes a constant-current controlled power supply circuit and at least a pair of illumination lamp connection parts, wherein each of the pair of illumination lamp connection parts includes a pair of terminals to which an illumination lamp can be connected, one of the terminals of one of the illumination lamp connection parts being connected to a positive output end of the power supply circuit and the other of the terminals being connected to a non-potential connection end, one of the terminals of another of the illumination lamp connection parts being connected to the non-potential connection end and the other of the terminals being connected to a negative output end of the power supply circuit;

a first voltage detection circuit to detect a voltage between the positive output end and the negative output end of the power supply circuit;

a second voltage detection circuit to detect a voltage between the non-potential connection end and the positive output end or the negative output end; and a control circuit that determines a number of illumination lamps connected to the direct-current power supply device based on detection outputs of the first and second voltage detection circuits, and selects, based on the determined number, one or more voltage thresholds for causing the power supply circuit to perform a predetermined operation.

2. The device of claim 1, wherein the voltage thresholds include an upper limit voltage threshold and a lower limit voltage threshold, and the power supply circuit is caused to perform a protecting operation when the detection output of one of the voltage detection circuits deviates above the upper limit voltage threshold or below the lower limit voltage threshold.

3. The device of claim 2, wherein the voltage thresholds include two additional voltage thresholds between the upper limit voltage threshold and the lower limit voltage threshold.

4. The device of claim 3, wherein the voltage thresholds selected when the determined number is one are different from the voltage thresholds selected when the determined number is two.

5. The device of claim 1, wherein the predetermined operation is a protecting operation.

6. The device of claim 1, wherein the control circuit determines the number of illumination lamps connected to the direct-current power supply device as one if the detection output of one of the first and second voltage detection circuits is zero and the detection output of the other of the first and second voltage detection circuits is equal to a voltage rating of one illumination lamp.

7. The device of claim 1, wherein the control circuit determines the number of illumination lamps connected to the direct-current power supply device as two if the detection output of one of the first and second voltage detection circuits is equal to a voltage rating of one illumination lamp and the detection output of the other of the first and second voltage detection circuits is equal to a voltage rating of two illumination lamps.

8. A lighting device comprising:

a direct-current power supply device that includes a constant-current controlled power supply circuit and at least a pair of illumination lamp connection parts, wherein each of the pair of illumination lamp connection parts includes a pair of terminals to which an illumination lamp can be connected, one of the terminals of one of the illumination lamp connection parts being connected to a positive output end of the power supply circuit and the other of the terminals being connected to a non-potential connection end, one of the terminals of another of the illumination lamp connection parts being connected to the non-potential connection end and the other of the terminals being connected to a negative output end of the power supply circuit;

a first voltage detection circuit to detect a voltage between the positive output end and the negative output end of the power supply circuit;

a second voltage detection circuit to detect a voltage between the non-potential connection end and the positive output end or the negative output end; and a control circuit that determines voltage thresholds according to detection outputs of the first and second voltage detection circuits each time a lighting condition of one or more illumination lamps connected to the illumination lamp connection parts is changed, and controls the power supply circuit to perform a protecting operation when the detection output of the first or the second voltage detection circuit deviates from the thresholds.

9. The device of claim 8, wherein the voltage thresholds include an upper limit voltage threshold and a lower limit voltage threshold, and the power supply circuit is caused to perform the protecting operation when the detection output of one of the voltage detection circuits deviates above the upper limit voltage threshold or below the lower limit voltage threshold.

10. The device of claim 9, wherein the voltage thresholds include two additional voltage thresholds, one above the upper limit voltage threshold and one below the lower limit voltage threshold.

11. The device of claim 10, wherein the two additional voltage thresholds remain constant even when the lighting condition of the illumination lamp is changed.

12. A luminaire comprising:

one or more illumination lamps; and a lighting device having a direct-current power supply device that includes a constant-current controlled power supply circuit and at least a pair of illumination lamp connection parts to which the one or more illumination lamps are connected, wherein each of the pair of illumination lamp connection parts includes a pair of terminals to which an illumination lamp can be connected, one of the terminals of one of the illumination lamp connection parts being connected to a positive output end of the power supply circuit and the other of the terminals being connected to a non-potential connection end, one of the terminals of another of the illumination lamp connection parts being connected to the non-potential connection end and the other of the terminals being connected to a negative output end of the power supply circuit, and a pair of illumination lamps being connected in series between the positive output end and the negative output end of the power supply circuit through the non-potential connection end, a first voltage detection circuit to detect a voltage between the positive output end and the negative output end of the power supply circuit, a second voltage detection circuit to detect a voltage between the non-potential connection end and the positive output end or the negative output end, and a control circuit to set one or more voltage thresholds in accordance with a number of illumination lamps connected to the illumination lamp connection parts, for causing the power supply circuit to perform a protecting operation.

13. The luminaire of claim 12, wherein the control circuit determines the number of illumination lamps connected to the illumination lamp connection parts as one if the detection output of one of the first and second voltage detection circuits is zero and the detection output of the other of the first and second voltage detection circuits is equal to a voltage rating of one illumination lamp.

14. The device of claim 12, wherein the control circuit determines the number of illumination lamps connected to the illumination lamp connection parts as two if the detection output of one of the first and second voltage detection circuits is equal to a voltage rating of one illumination lamp and the detection output of the other of the first and second voltage detection circuits is equal to a voltage rating of two illumination lamps.

15. The device of claim 12, wherein the voltage thresholds include an upper limit voltage threshold, a lower limit voltage threshold, and two additional voltage thresholds in between the upper limit voltage threshold and the lower limit voltage threshold.

16. The device of claim 15, wherein the two additional voltage thresholds are updated each time the lighting condition of the one or more illumination lamps is changed.

* * * * *